US005832972A

United States Patent [19]

Thomas et al.

[11] Patent Number: 5,832,972

[45] Date of Patent: Nov. 10, 1998

[54] DILUTION DISPENSING SYSTEM WITH PRODUCT LOCK-OUT

[75] Inventors: John E. Thomas, River Falls, Wis.; Daniel K. Boche, Eagan, Minn.; Bruce Henry, Winston Salem, N.C.; Eric R. Balz, Eagan, Minn.

[73] Assignee: Ecolab Inc., St. Paul, Minn.

[21] Appl. No.: 687,674

[22] Filed: Jul. 26, 1996

[51] Int. Cl.[6] ..... B65B 1/04

[52] U.S. Cl. ..... 141/360; 141/2; 141/9; 141/18; 141/361; 141/362; 141/383; 141/386; 222/888

[58] Field of Search ..... 141/2, 9, 18, 67, 141/104, 351, 360, 361, 362, 383, 386; 222/129.2, 145.1, 145.5, 181.2, 181.3; 137/888, 892; 73/864.65; 128/DIG. 24

[56] References Cited

U.S. PATENT DOCUMENTS

| | | | |
|---|---|---|---|
| 2,746,646 | 5/1956 | Hall . | |
| 4,150,673 | 4/1979 | Watt | 128/272 |
| 4,181,242 | 1/1980 | Zygiel . | |
| 4,807,783 | 2/1989 | Van Zijverden | 137/888 |
| 5,100,030 | 3/1992 | Roggenburg . | |
| 5,159,958 | 11/1992 | Sand . | |
| 5,228,598 | 7/1993 | Bally et al. . | |
| 5,248,067 | 9/1993 | Garcia . | |
| 5,293,913 | 3/1994 | Preszler . | |
| 5,361,904 | 11/1994 | Kapec et al. . | |
| 5,425,404 | 6/1995 | Dyer . | |
| 5,452,825 | 9/1995 | Comstock et al. . | |
| 5,597,019 | 1/1997 | Thomas et al. | 141/18 |
| 5,651,398 | 7/1997 | Decker et al. | 141/104 |

*Primary Examiner*—David J. Walczak
*Assistant Examiner*—Timothy L. Maust
*Attorney, Agent, or Firm*—Merchant, Gould, Smith, Edell, Welter & Schmidt, P.A.

[57] ABSTRACT

An apparatus and method for dispensing a dilute liquid concentrate with a diluent to form a dilute use solution for dispensing into a bottle. The dispensing apparatus 10 includes an aspirator 60 and a controller 50. The controller 50 includes an activation switch that is operable by being depressed in a first direction. A slide actuator 80 is mounted relative to the controller for movement in a second direction. The dispensing apparatus 10 also includes a lock-out member 100 to prevent the inadvertent use of an incorrect bottle while dispensing the use solution.

13 Claims, 5 Drawing Sheets

DILUTION DISPENSING SYSTEM WITH PRODUCT LOCK-OUT

BACKGROUND OF THE INVENTION

1. Field of the Invention

This invention relates generally to a dilution dispenser and more particularly to a dilution dispenser which has a product lock-out and also a dilution dispenser.

2. Description of the Prior Art

Dilution apparatus using an aspirator, to dilute a liquid concentrate with a liquid diluent to form a use solution, have been used for many years. The first such systems were ad hoc, loose assemblies of tubing, connections, aspirators, etc. The typical prior art diluting station comprises a large reservoir of concentrate, a source of diluent, typical service water, and a receiving container for the dilute use solution. Such a dilution apparatus is operated by passing service water or other aqueous stream through the aspirator containing a venturi. A venturi draws the liquid concentrate from the bulk into contact with the aqueous diluent stream, mixes the diluent and concentrate forming a use solution which is then transferred to a use solution container. The configuration of such a dilution apparatus has taken a large variety of embodiments. Large numbers of embodiments of concentrate containers, transfer mechanism, aspirator control means, use solution containers and various combinations of these elements have been attempted in the past.

In the past, the prior art dilution systems have a hose or conduit at the end of the venturi for the dispensing of the use solution. This conduit is simply placed inside of the bottle or container to receive the use solution. When a plurality of dispensers are used, for a plurality of chemicals, there is no control or mechanism to prevent a first chemical being placed in a bottle which was designed and labeled for a second chemical.

Still further, when activating the dispenser, it is often necessary to place the conduit in the bottle and then, with the other hand, activate the dispenser. There are prior art dispensers which are activated by means of pressing the bottle backward in the same direction as is necessary to push the switch which activates the dispenser. However, it is often more convenient from a design point to have the activation button move in one direction and the movement of the bottle in another direction. However, under prior art devices, it is not possible to have the movement of the bottle in one direction activate the switch in another direction.

Accordingly a substantial need exists for a new versatile diluting apparatus and diluting stations having one or more diluting apparatus. Such stations ideally will permit the dispensing of a variety of chemicals into corresponding keyed bottles to make certain that the correct use solution is dispensed into the correct bottle. Further, there is a substantial need for a diluting apparatus wherein simple movement of the bottle in a first direction into the diluting apparatus will activate a switch, which moves in a second direction to begin the dispensing of the use solution.

SUMMARY OF THE INVENTION

The invention is an apparatus for diluting a liquid concentrate with a liquid diluent to form a dilute use solution for dispensing into a bottle. The apparatus includes an aspirator having a liquid diluent inlet, and inlet for liquid concentrate and an outlet for dilute use solution. A controller is operatively connected to the aspirator with means to control flow of liquid diluent from a source of liquid diluent to the aspirator inlet. The control means has an activation switch that is operable by being depressed in a first direction. Also provided is a means for depressing the activation switch. The depressing means has a first end proximate the outlet and a second end proximate the activation switch. The depressing means is mounted relative to the controller for movement in a second direction, wherein a bottle is placed against the first end and moved in the second direction, thereby depressing the activation switch and allowing the dilute use solution to flow into the bottle.

The invention is also an apparatus for diluting a liquid concentrate with a liquid diluent to form a dilute use solution for dispensing into a bottle. The apparatus includes a housing adapted and configured to be mounted on a wall or other suitable mounting surface. An aspirator has a liquid diluent inlet, an inlet for liquid concentrate in an outlet for dilute use solution. The aspirator is positioned in the housing. A controller, operatively connected to the aspirator, includes a means to control flow of liquid diluent from a source of liquid diluent to the aspirator inlet. The control means has an activation switch that is operable by being depressed in a first direction. The controller is positioned in the housing. A mounting bracket is secured to the controller. The mounting bracket has first and second ends. A slide member, moveable in a second direction, is positioned on the mounting bracket. The slide member has an inclined portion, wherein when in a first position the activation switch is in a non-use position and when the slide member is moved to a second position, the inclined portion moves the activation switch to a use position and causes the dilute use solution to flow out of the outlet.

The invention also includes a dispensing apparatus for supplying a liquid to a bottle having a neck with a geometric cross-sectional configuration. This dispensing apparatus includes a housing having an interior cavity and an exit aperture. A dispensing mechanism is positioned in the housing. A lock-out member is operatively connected to the exit aperture. The lock-out member has an opening, a cross-section of which has a geometric configuration matching the cross-sectional configuration of the neck of the bottle, wherein necks of bottles of different geometric cross-sectional configurations can not enter the exit.

The invention is also a dispensing system for a plurality of bottles. The dispensing system includes a plurality of dispensing apparatus. Each of the dispensing apparatus includes a housing having an inner cavity and an exit aperture, a dispensing mechanism positioned in the housing and a lock-out member operatively connected to the exit aperture, the outlet member having an opening. Each of the plurality of bottles have a neck having a different geometric cross-sectional configuration. Each of the plurality of lock-out members have a cross-sectional geometric configuration which matches the geometric configuration of the respective bottles, wherein necks of bottles have different configurations can not enter the exit.

The invention is also an apparatus for diluting a liquid concentrate with a liquid diluent to form a dilute use solution for dispensing into a bottle. The apparatus includes an aspirator having a liquid diluent inlet, an inlet for liquid concentrate and an outlet for dilute use solution. A conduit is in fluid communication with the aspirator outlet, the conduit having a longitudinal axis. A controller is operably connected to the aspirator with means to control the flow of liquid diluent from a source of liquid diluent to the aspirator inlet. The control means has an activation switch. A means for depressing the activation switch is provided. The depression means is mounted to the controller for movement substantially parallel to the longitudinal axis of the conduit.

The invention is also a method dispensing a use solution into a bottle from a dispenser. The dispenser has an aspirator, a conduit and fluid communication with the aspirator and a controller for controlling flow of a liquid diluent to the aspirator inlet. The method includes placing a bottle under the dispenser. Then, the outlet conduit of the dispenser is inserted into the bottle. The bottle is then moved along a line substantially parallel to the longitudinal axis of the outlet conduit to activate dispensing of the use solution.

DETAILED DESCRIPTION OF A PREFERRED EMBODIMENT

Figure 1:
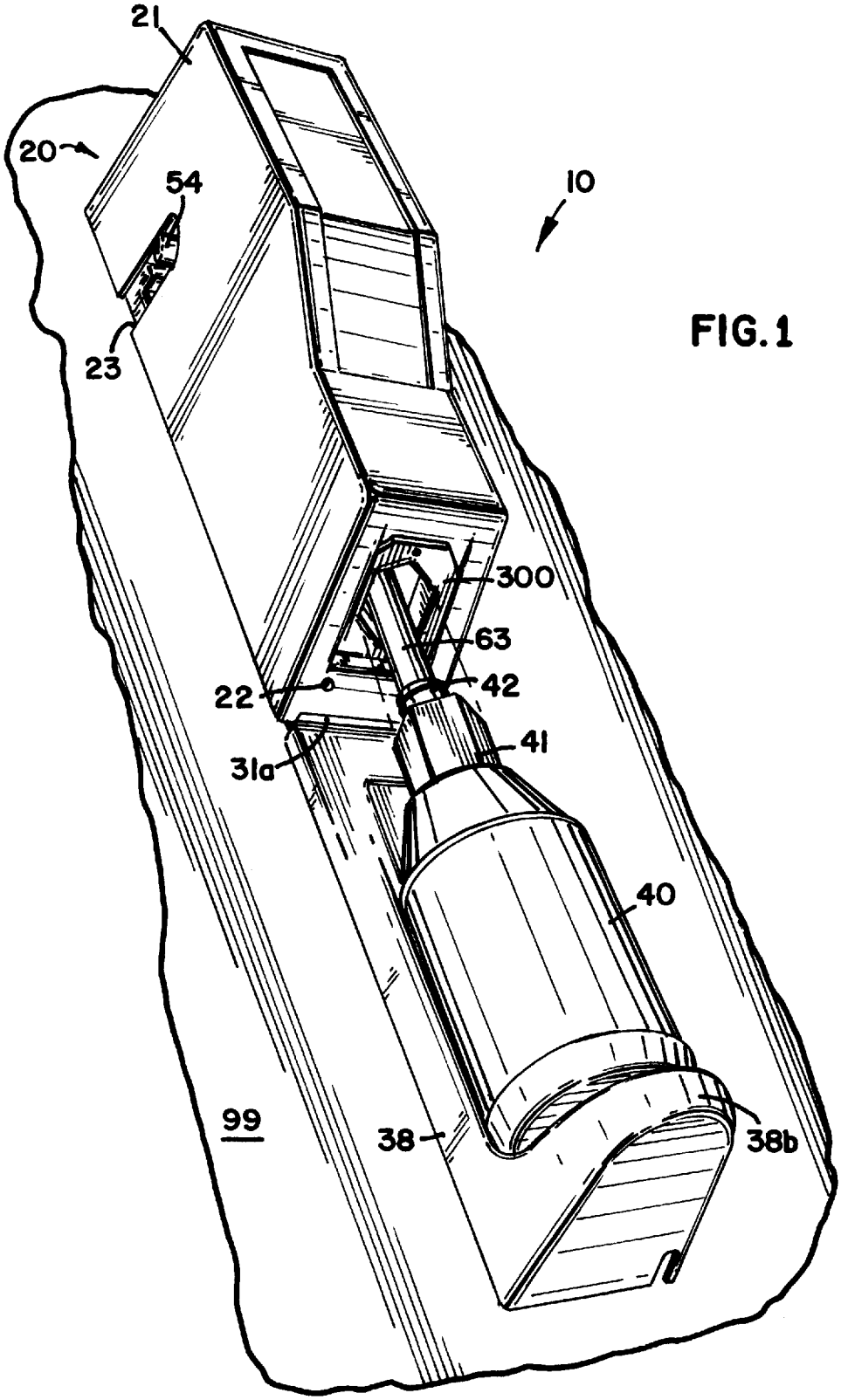
FIG. 1 is a perspective view of the dispensing apparatus of the present invention.

The apparatus of the invention for diluting a liquid concentrate to a dilute liquid use solution contains an aspirator. Aspirators contain a venturi device driven by water pressure to draw a concentrate. The venturi device comprises a nozzle opening associated with a body of concentrate solution. The velocity of the diluent through the nozzle causes a reduction in pressure, draws the concentrate into the aspirator, generally causing a mixing of the concentrate and diluent typically at a fixed ratio depending on pressure, tubing sizes and length. Once diluted and mixed, the dilute use solution leaves the aspirator through an outlet for the dilute use solution. The outlet is in liquid communication with the use solution container. The aspirator is typically sized and adapted to diluent pressure that ranges from about 10 to about 60 psig. Preferably, service water is available in most municipalities at a pressure of about 20 to 40 psig. The apparatus of this invention works best at such a pressure. However, the apparatus can be adapted for a variety of water pressures.

The concentrate materials of the invention include general purpose cleaning and sanitizing materials, coating compositions and other useful institutional or industrial liquid concentrates. Such materials include window cleaners, hand soap, hard surface cleaners, floor cleaners, sink cleaners, tile cleaners, drain cleaners and drain openers, glass cleaners, cleaners for food preparation units, sanitizers, disinfectants, aqueous coating compositions, water reducible concentrates, water reducible floor finishes, aqueous wax dispersions, air fresheners, odor counteractants, and other similar concentrates that can be formed as an aqueous solution, an aqueous alcoholic solution, an aqueous dispersion, an aqueous reducible solution or dispersion, etc.

The liquid concentrate materials useful for dilution to a dilute use solution typically comprise aqueous solutions, aqueous suspensions, aqueous reducible concentrates, aqueous alcoholic concentrates, etc., of cleaning or sanitizing chemicals. The concentrate can contain about 20 to 90 wt % of active cleaning materials. The typical viscosity of the liquid concentrates typically ranges from about 1 to 400 cP. The chemical systems can comprise a surfactant based cleaner, an antimicrobial, a floor finish, etc. The cleaner can be a generally neutral system, an acid-based system containing compatible surfactant, cosolvents and other additives or alkaline systems containing a source of alkalinity, compatible surfactants, cosolvents, etc.

The apparatus is typically adapted and configured to dilute a variety of liquid concentrates to useful dilute use solutions. The cross contamination should be avoided. Acid cleaners can render basic cleaners inoperative. Further, the addition of a chlorine source to an acid can release inappropriate toxic fumes. A variety of other inappropriate interactions can occur resulting ultimately in a use solution that is not appropriate for its intended purpose.

Figure 8:
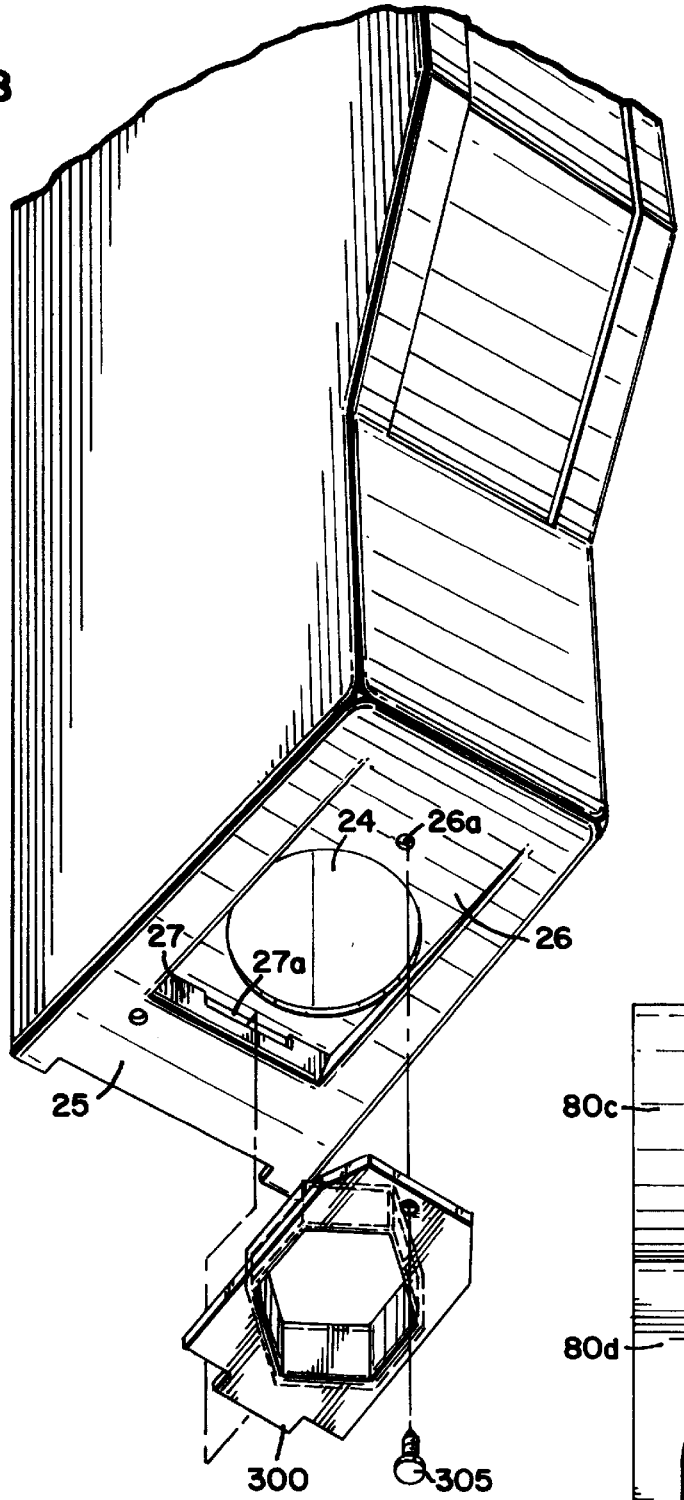
FIG. 8 is an enlarged perspective view of the bottom portion of the dispenser in FIG. 1 and showing a lock-out member in an exploded position.

There is generally disclosed at 10 an apparatus for diluting a liquid concentrate with a liquid diluent to form a dilute use solution for dispensing into a bottle. The dispensing apparatus 10 includes a housing 20 which includes a cover 21 and a base 31. The cover 21 and base 31 may be formed from any suitable material such as a suitable molded plastic. The cover 21 is secured to the base 31 by a suitable means such as screws 22. The cover has two access openings 23 on its side. As shown in FIG. 1, only one access opening 23 is shown. However, as will be described more fully hereafter, a similar access opening is positioned on the opposite side of the cover 21 to allow access for the diluent. Formed at the bottom of the cover 21 is an opening 24. The opening 24 is best seen in FIG. 8. The bottom of the housing 20 has a first surface 25 which, when mounted, is at a slight incline to the horizontal. A second surface 26, in which the hole 24 is formed, is generally horizontal when the dispenser 10 is mounted. A ledge 27 is formed between the two surfaces 25 and 26. The ledge 27 has a rectangular slot **27*a* formed therein. A screw opening 26*a* is formed in the second surface 26**. This structure forms the basis for mounting of various lock-out members.

Figure 5:
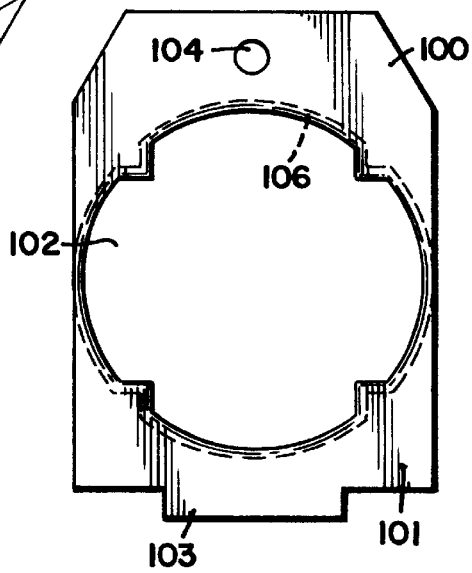
FIG. 5 is one embodiment of a lock-out member for use with the present invention.
Figure 6:
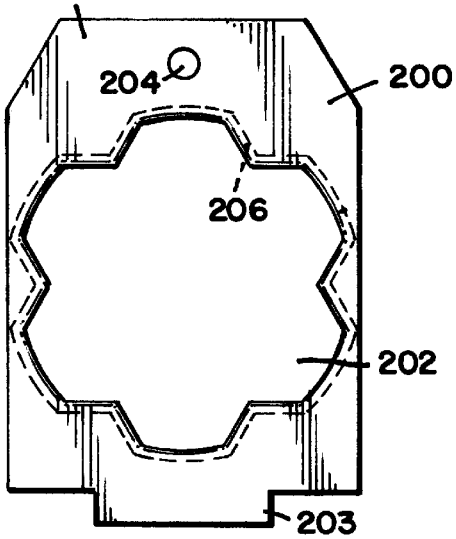
FIG. 6 is a second embodiment of a lock-out member for use with the present invention.
Figure 7:
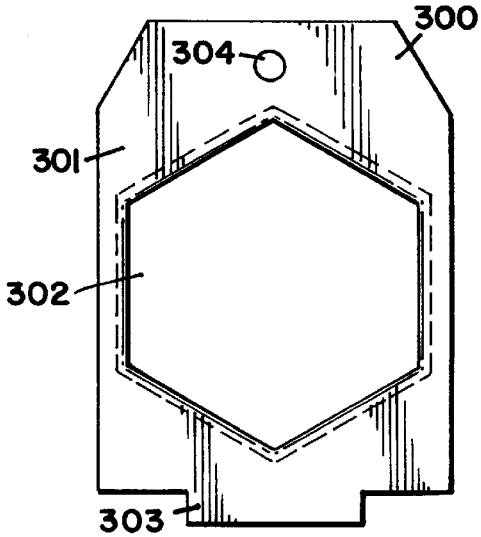
FIG. 7 is a third embodiment of a lock-out member for use with the present invention.
Figure 10:
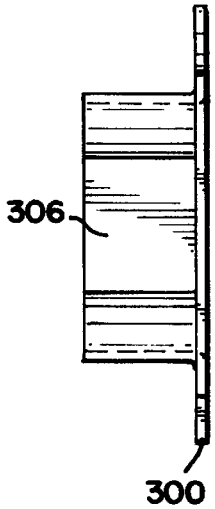
FIG. 10 is a right side elevational view of the lock-out shown in FIG. 7.

Several embodiments of lock-out members are shown. FIG. 5 is lock-out member 100, FIG. 6 is lockout member 200, FIG. 7 is lock-out member 300. Referring to FIGS. 7, 8, and 10, lock-out member 300 will be described in more detail. Lock-out member 300 has a generally planar surface 301 in which an aperture 302 is formed. The surface 301 has a tab 303 and a screw opening 304. The tab 303 is inserted into the slot **27*a* and a screw 305 is inserted through the screw opening 34 and fastened into the screw opening 26*a* to secure the lock-out member 300 in the housing 20. The lock-out member 300 has a collar 306. The collar 306 extends inward into the cavity inside of the housing 20. The collar 306 is positioned proximate the member 80*d* of the slide actuator 80. As can be seen best in FIG. 7, the aperture 302 has a geometric cross-sectional configuration of a hexagon. The lock-out member 300 is designed to be used with a bottle 40, as shown in FIG. 1. The bottle 40 is the bottle in which the use solution is dispensed. The bottle 40 has a generally cylindrical bottom portion for receiving the use solution. The bottle 40 has a neck 41 that is smaller diameter than the cylindrical portion. The neck 41 has a geometric cross-sectional configuration of a hexagon which matches that of the lock-out member 300. Therefore, the neck 41 is able to pass through the aperture 302 as it has a matching cross-sectional configuration. At the top of the neck 41 is a threaded opening 42** for receiving a cap (not shown).

FIG. 5 shows a lock-out member 100 which, similar to lock-out member 300, has a planar surface 101, aperture 102, tab 103, screw opening 104. The cross-sectional configuration of the opening 102 is circular with four inwardly projecting 90° tabs. A collar 106 extends inward and has the same cross-sectional configuration as the aperture 102.

FIG. 6 shows still another example of a lock-out member 200 having a planar surface 201, aperture 202, tab 203, and screw opening 204. The geometric cross-sectional configuration of the aperture 202 is generally circular with six inwardly projecting tabs. A collar 206 has a similar cross-sectional configuration as the aperture 202.

Figure 2:
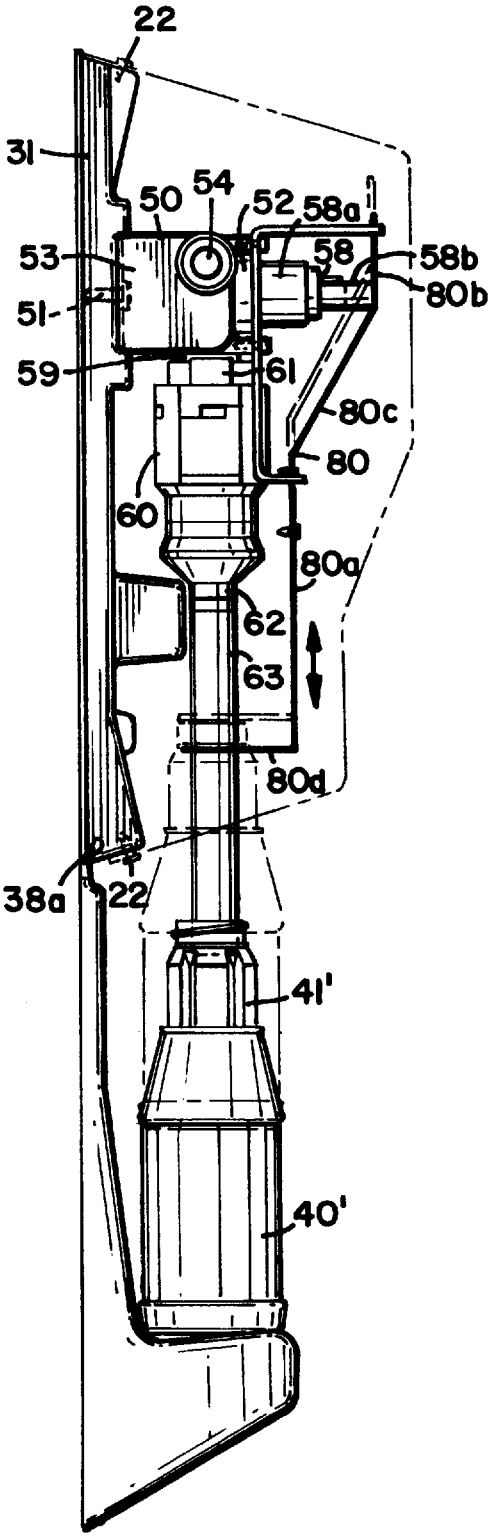
FIG. 2 is a left side elevational view of the dispenser shown in FIG. 2, with the housing shown in phantom.

FIG. 2 discloses a bottle 40' for use with lock-out 100. The bottle 40' has a generally cylindrical bottom portion to receive the use solution and a neck portion 41' which has a cross-sectional geometric configuration which matches the lock-out 100. It is understood that various other configurations may be utilized. An important factor is to design a cross-sectional configuration which only accepts the geometric configuration which is similar to the lock-out member's aperture and does not allow other geometric configurations, of similar size, to pass through. That is, the bottle 40' would not pass through lock-out member 300 or 200. Similarly, the bottle 40 would not pass through lock-out members 100 or 200. This is important, as will be discussed more fully hereafter, for the prevention of filling a specific bottle with the wrong chemical use solution.

A drip tray 38 is positioned under the housing 20. The base 31 has a rectangular slot 31*a* under which a lip 38*a* of the drip tray 38 is inserted. This interlock holds the drip tray 38 in position underneath the housing 20. The drip tray 38 has a base member 38*b* on which the bottom of a bottle to be filled may rest. The distance between the top of the base member 38*b* and the bottom of the housing 20 is greater than the height of the bottle in which the use solution will be placed. The base 31 has two keyed slots 31*b* which may be used to mount the dispensing apparatus 10 to a suitable mounting surface such as a wall 99.

A controller or valve 50 is mounted to the base 31 by a means of screws 51. The controller or valve 50 may be any suitable valve such as model 633 B-EL valve assembly, made by Dema Engineering of St. Louis, Mo. The controller 50 has a valve body 52 and side mounting plates 53. The screws 51 are positioned between the side mounting plates 53 and the valve body 52. Pipe plug 54 is operatively connected to the valve body 52. The valve 50 has an inlet 55 to which a connector 56 is mounted. The inlet 55 and connector 56 exted out of the housing 20 thru an opening sized and shaped like access opening 23. The connector 56 is adapted to receive the diluent inlet hose 57. Mounted to the valve body 52 is an activation switch 58. The activation switch 58 includes a body 58*a* in which a depressable push button 58*b* is mounted. The button 58*b* is mounted in the body 58*a* with a spring which biases the button away from the valve body to an off position. The valve body 52 has a threaded outlet 59.

An aspirator 60 is in fluid communication with the outlet 59. The aspirator 60 may be any suitable model such as the Air Gap Proportioner 4GPM number 10070400 made by Hydro Systems Company of Cincinatti, Ohio. In the embodiment shown, the aspirator 60 is an air gap aspirator. The aspirator 60 has an inlet 61 which is in fluid communication with the outlet 59. The aspirator 60 includes a venturi which has an inlet that is in fluid communication with an elbow 69. One end of the elbow 69 is connected to the venturi inlet and the other end has a barbed connection for connecting to a conduit (not shown) which is in turn placed in a container of liquid concentrate (not shown) previously discussed. The aspirator has an outlet 62 that is in fluid communication with an outlet conduit 63. In this particular model of the aspirator, the outlet conduit 63 is a dual conduit. The inner conduit dispenses the dilute use solution and the outer conduit conducts any spilled diluent into the bottle 40.

Figure 4:
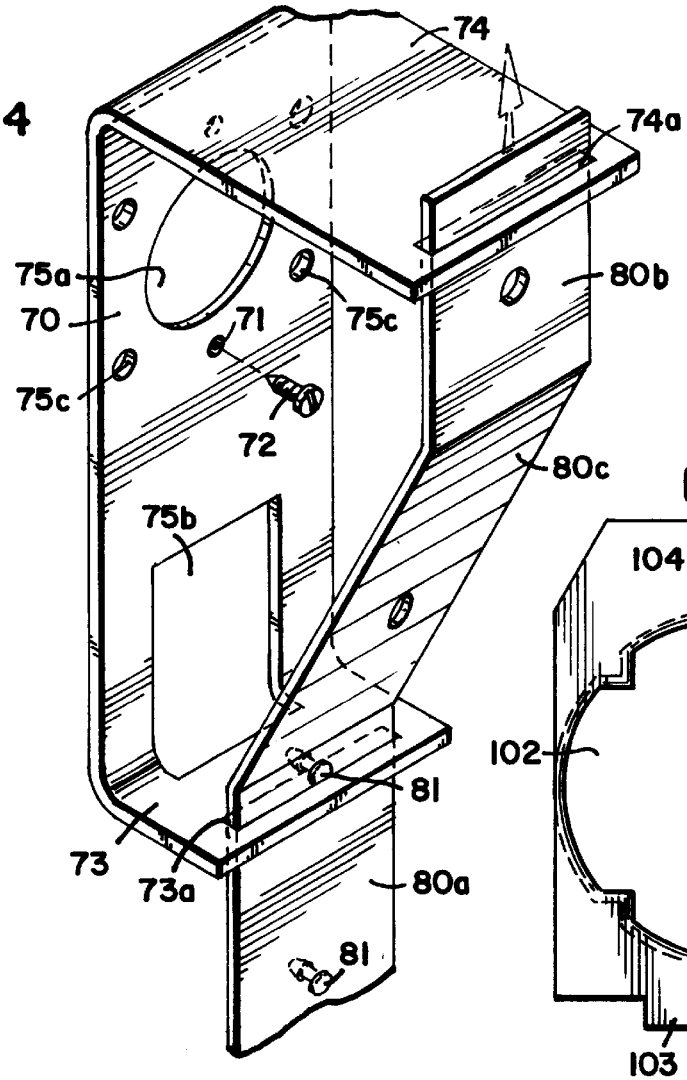
FIG. 4 is an enlarged perspective view of the bracket and slide actuator shown in FIG. 2.

A bracket 70, as best shown in FIGS. 2 and 4, is secured by means of screws 72 through a hole 71. The screws 72 connects the bracket 70 to the controller 50. The bracket has a first side member 73 connected to a second side member 74 by an intermediate member 75. The first side member 73 has a rectangular slot 73*a* and the second side member 74 has a rectangular slot 74*a*. The intermediate member 75 has an aperture 75*a* through which the activation switch body 58*a* is inserted and a rectangular opening 75*b* through which a portion of the aspirator 60 extends. Also provided are access holes 75*c*. The holes 75*c* allow access in order to tighten the screws 51 which connects the controller 50 to the base 31. The rectangular slot 73*a* is spaced closer to the intermediate member 75 than is the rectangular slot 74*a*.

Figure 9:
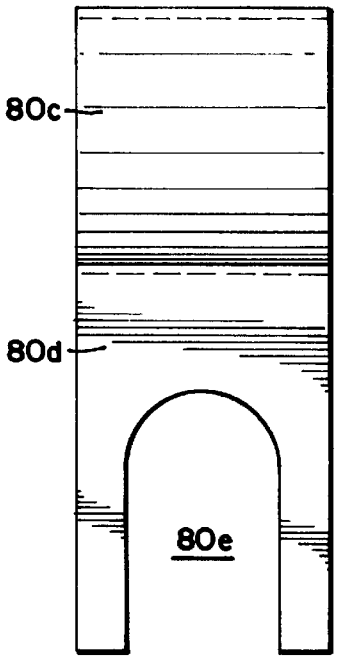
FIG. 9 is a view taken generally along the lines 9—9 showing only the slide actuator.

A slide actuator 80 has a first portion 80*a* connecting a second section 80*b* by an angled (or inclined) intermediate portion 80*c*. At the end of the first portion 80*a* is a downwardly depending member 80*d*. As shown in FIG. 9, this member 80*d* has a slot 80*e* through which the outlet conduit 63 may be inserted. The first portion 80*a* is inserted through the rectangular slot 73*a* and the second portion 80*b* is inserted into the slot 74*a*. The bracket 70 is typically made of plastic and is therefore deformable to allow the second portion 80*b* to be inserted into this rectangular slot 74*a*. Two motion limiting stops 81 are positioned through entry holes in the first portion 80*a*. These stops 81 limit the linear movement of the slide actuator, as will be discussed more fully hereafter.

Referring to FIG. 2, in use, a bottle 40' having a correspondingly keyed collar 41' to the appropriate lock-out 100, is placed on the base member 38*b* of the drip tray 38. In this position, the top of the bottle is spaced away from the bottom of the housing 20. The conduit 63 is placed inside of the bottle 40'. Typically, since the conduit 63 extends into the bottle when it is placed on the base 38*a*, it is usually advisable to insert the conduit into the bottle as it is being positioned under the housing 20 and onto the drip tray. Then, the bottle 40' is moved upward, as shown by the phantom lines in FIG. 2. This is generally parallel to a longitudinal axis of the conduit. It is necessary to orient the neck 41' of the bottle 40' so as to allow it to pass through the lock-out aperture 102 and make contact with the member 80*d* of the slide actuator 80. Then, as the bottle continues to move upward the slide actuator 80 is moved upward, as shown by the phantom line in FIG. 2.

When the slide actuator is in a first position (non-use), the button 58*b* is fully extended and is under the second portion 80*b*. Then, as the slide actuator is moved to a second position (use), the inclined portion 80*c* contacts the button 80*b* and depresses it downward as the slide bracket travels in a direction substantially parallel to the longitudinal axis of the conduit 63. The motion of the button 80*b* is in a direction substantially perpendicular to that of the movement of the bottle 40'. However, it is understood that other angled relationships may also be utilized with the present invention. The angle of the incline is approximately 30°. It is preferable that approximately ¾ inch of the travel of the slide actuator will cause approximatley ½ inch movement of the button. With this ½ inch movement, the button is then depressed and the dispenser is activated. That is, the controller 50 then allows a use solution to enter the valve body 52 through its inlet 55. The water then exits the outlet 59 through a nozzle and is sprayed through the venturi of the aspirator 60. This in turn causes the liquid concentrate to be picked up through its inlet 61 from the liquid concentrate (not shown). It is well known in the art how a conduit is connected to the barbed end of the elbow 69 and is placed into a reservoir of liquid concentrate. Then, the dilute use solution exits the outlet 62 into the outlet conduit 63 and finally into the bottle 40'. The stops 81 prevent excessive movement of the slide actuator and properly positions the slide actuator.

The lock-outs 100, 200, and 300 are color coded to their respective bottles. That is, the bottle which has the same geometric cross-sectional configuration as the lock-out will have a colored label the same color as the lock-out. This will assist the operator in making certain that they fill the bottle with the correct use solution.

Figure 3:
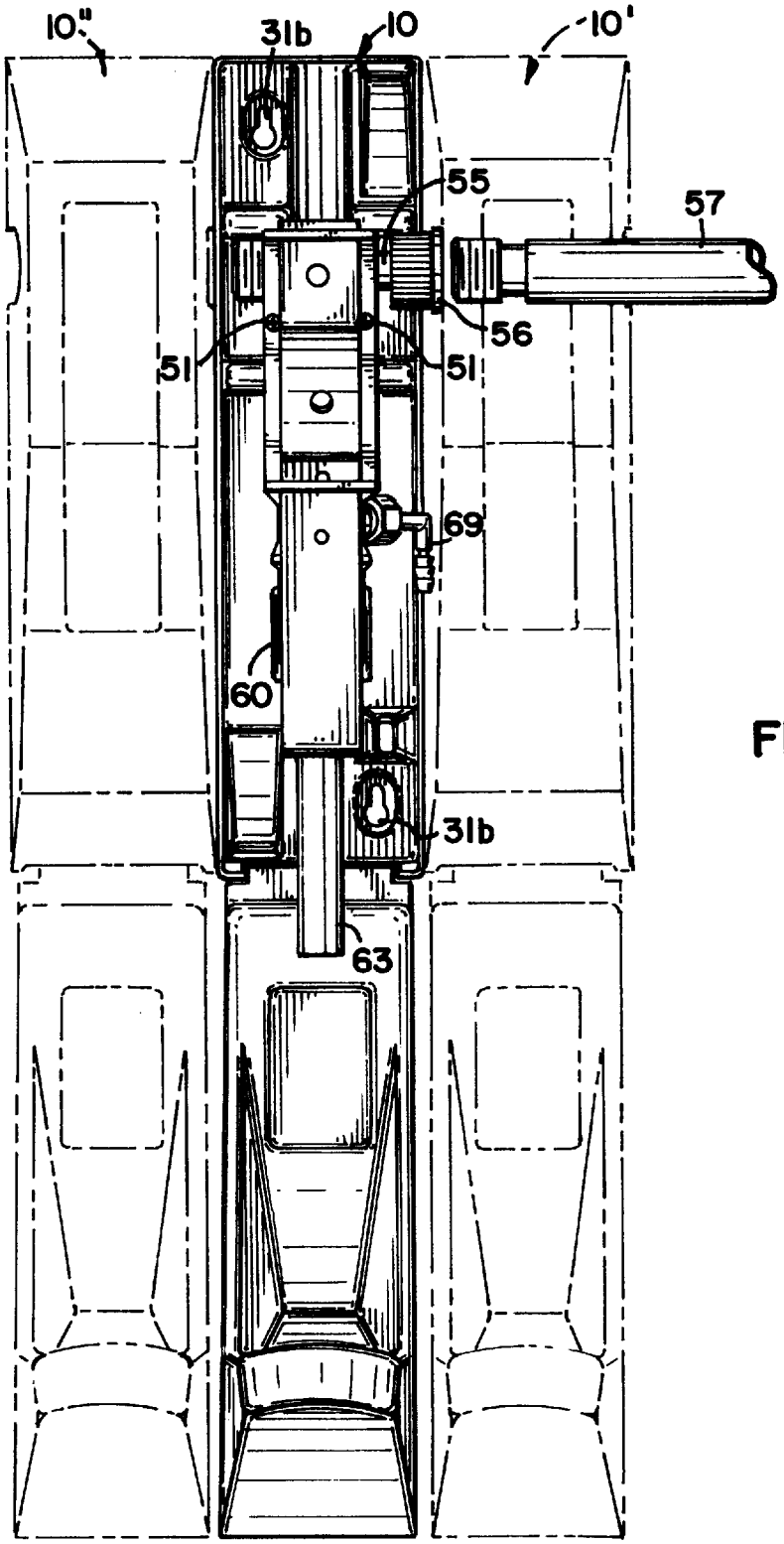
FIG. 3 is a front elevational view of the dispenser shown in FIG. 1 with the housing removed and also showing additional dispensers in phantom.

FIG. 3 shows a dispensing system which includes a plurality of dispensers 10, 10', and 10". The dispensers 10' and 10" are identical to dispenser 10, with the exception of using a different lock-out member. When used in a system such as shown in FIG. 3, three different liquid concentrates may be dispensed. Each of the dispensers 10, 10', and 10" have a different lock-out member associated therewith. Accordingly, three bottles, each having a corresponding cross-sectional configuration as the opening of the lock-outs, would be used with each dispenser. The bottle which is in use for dispenser 10', would not be able to enter the opening of the dispenser 10 or 10'. Therefore, the bottle would not be able to activate the wrong dispenser since it would not be able to move the slide actuator 80 since it would not be able to pass through the opening of the lock-out.

Another feature of the present invention is that the lock-outs are replaceable. While it is, of course, desireable that the correct bottle be used, there may be certain circumstances where an operator would run out of one type of bottles. In such a case, the lock-out may be easily removed by simply removing the screw and lifting the tab out of the opening. Then, the entire opening 24*a* is available for a bottle to be inserted to actuate the slide actuator 80.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An apparatus for diluting a liquid concentrate with a liquid diluent to form a dilute use solution for dispensing into a bottle comprising:

a) an aspirator having a liquid diluent inlet, an inlet for liquid concentrate and an outlet for dilute use solution;

b) a valve, operably connected to the aspirator, with means to control flow of liquid diluent from a source of liquid diluent to the aspirator inlet, the control means having an activation switch that is operable by being depressed in a first direction; and c) means for depressing the activation switch, the depressing means having a first end proximate the outlet and a second end proximate the activation switch, said depressing means mounted relative to the valve for movement in a second direction, wherein a bottle is placed against the first end and moved in the second direction, thereby depressing the activation switch, and allowing the dilute use solution to flow into the bottle.

2. The apparatus of claim 1, wherein said depressing means comprises:

a) a mounting bracket secured to the valve, the mounting bracket having first and second ends; and b) a slide member, movable in a second direction, positioned on the mounting bracket, the slide member is moved to a second position, the inclined portion moves the activation switch to a use position and causes the dilute use solution to flow out the outlet.

3. The apparatus of claim 2, wherein said like member comprises:

a) a conduit operatively connected to the outlet; the conduit having a longitudinal axis generally parallel to the second direction;

b) a first member operatively connected to a second member by the inclined portion; and c) the first member having a depending portion having an opening for the conduit.

4. The apparatus of claim 3, wherein the mounting bracket comprises:

a) a first member having a slot thru which the first member of the slide member slides; and b) a second member having a slot thru which the second member of the slide member slides.

5. The apparatus of claim 4, further comprising a first stop and a second stop operatively connected to said slide member, the first stop positioned on one side of first member of the mounting bracket and the second stop positioned on the other side of the first member of the mounting bracket.

6. The apparatus of claim 1, further comprising:

a) a housing having an inner cavity and an exit aperture; and b) a lock-out member operatively connected to the exit aperture, the lock-out member having an opening, a cross-section of which has a geometric configuration matching the cross-sectional configuration of the neck of the bottle, wherein necks of bottles of different geometric cross-sectional configurations can not enter the exit.

7. An apparatus for diluting a liquid concentrate with a liquid diluent to form a dilute use solution for dispensing into a bottle comprising:

a) a housing adapted and configured to be mounted on a wall;

b) an aspirator having a liquid diluent inlet, an inlet for liquid concentrate and an outlet for dilute use solution, the aspirator positioned in the housing;

c) a controller, operably connected to the aspirator, with means to control flow of liquid diluent from a source of liquid diluent to the aspirator inlet, the control means having an activation switch that is operable by being depressed in a first direction, the controller positioned in the housing;

d) a mounting bracket secured to the controller, the mounting bracket having first and second ends; and e) a slide member, movable in a second direction, positioned on the mounting bracket, the slide member having an inclined portion, wherein when in a first position the activation switch is in a non-use position and when the slide member is moved to a second position, the inclined portion moves the activation switch to a use position and causes the dilute use solution to flow out the outlet.

8. A dispensing apparatus for supplying a liquid to a bottle having a neck with a geometric cross-sectional configuration, comprising:

a) a housing having an inner cavity and an exit aperture;

b) a dispensing mechanism positioned in the housing; and c) a lock-out member operatively connected to the exit aperture, the lock-out member having an opening, a cross-section of which has a geometric configuration matching the cross-sectional configuration of the neck of the bottle, wherein necks of bottles of different geometric cross-sectional configurations can not enter the exit.

9. The dispenser of claim 8, wherein movement of the bottle into the exit activates the dispenser, thereby liquid is dispensed only into a proper bottle.

10. The dispenser of claim 9, the lock-out is replaceable connected to the dispenser.

11. A dispensing system for supplying a plurality of use solutions selectively to a plurality of bottles, comprising:

a) a plurality of dispensing apparatus, each dispensing apparatus comprising:

i) a housing having an inner cavity and an exit aperture;

ii) a dispensing mechanism positioned in the housing; and iii) a lock-out member operatively connected to the exit aperture, the lock-out member having an opening;

b) each of the plurality of bottles having a neck having a different geometric cross-sectional configuration;

c) each of the plurality of lock-out members having a cross-sectional geometric configuration which matches the geometric configuration of their respective bottles, wherein necks of bottles having different configurations can not enter the exit.

12. An apparatus for diluting a liquid concentrate with a liquid diluent to form a dilute use solution for dispensing into a bottle comprising:

a) an aspirator having a liquid diluent inlet, an inlet for liquid concentrate and an outlet for dilute use solution;

b) a conduit in fluid communication with the aspirator outlet, the conduit having a longitudinal axis;

c) a valve, operably connected to the aspirator, with means to control flow of liquid diluent from a source of liquid diluent to the aspirator inlet, the control means having an activation switch; and d) means for depressing the activation switch, the depression means mounted to the valve for movement substantially parallel to the longitudinal axis of the conduit.

13. A method of dispensing a use solution into a bottle from a dispenser having an aspirator having a liquid diluent inlet for liquid concentrate and an outlet for dilute use solution, a conduit in fluid communication with the aspirator outlet, the conduit having a longitudinal axis, a valve, operably connected to the aspirator, with means to control flow of liquid diluent from a source of liquid diluent to the aspirator inlet, the control means having an activation switch, means for depressing the activation switch, the depression means mounted to the valve for movement substantially parallel to the longitudinal axis of the conduit; comprising:

a) placing a bottle under the dispenser;

b) inserting the outlet conduit in to the bottle; and c) moving the bottle along a line substantially parallel to the longitudinal axis of the outlet conduit to activated dispensing of the use solution.

* * * * *